United States Patent [19]

Adkison

[11] 3,978,902

[45] Sept. 7, 1976

[54] LOCATOR-HOLDER FOR KEYS

[76] Inventor: Frances Leedell Adkison, 510-21st St., NW., Washington, D.C. 20006

[22] Filed: Dec. 19, 1975

[21] Appl. No.: 642,546

[52] U.S. Cl. ..... 150/34; 70/456 R; 248/205 A

[51] Int. Cl.[2] ..... A45C 1/00

[58] Field of Search ..... 150/34, 40; 248/205; 24/3 K, 201 B; 70/456 R, 457, 458, 459

[56] References Cited

UNITED STATES PATENTS

| | | | |
|---|---|---|---|
| 2,117,989 | 5/1938 | Ryan | 150/34 |
| 2,224,972 | 12/1940 | Long, Jr. | 150/34 |
| 3,007,568 | 11/1961 | Kurland | 150/40 |
| 3,009,225 | 11/1961 | Budreck | 70/457 |
| 3,025,580 | 3/1962 | Castle | 150/40 |
| 3,086,268 | 4/1963 | Chaffin | 70/457 |
| 3,302,678 | 2/1967 | Leguillon | 150/40 |
| 3,415,300 | 12/1968 | Worcester | 150/34 |
| 3,682,216 | 8/1972 | Nelson | 150/40 |

FOREIGN PATENTS OR APPLICATIONS

| | | | |
|---|---|---|---|
| 845,526 | 8/1960 | United Kingdom | 70/457 |

*Primary Examiner*—Ro E. Hart

[57] ABSTRACT

This invention provides a new and simplified method of suspending keys within a purse through the use of flexible magnetic tape, secured to the wall of a purse, and the mating thereto of a piece of steel designed to carry keys.

1 Claim, 2 Drawing Figures

LOCATOR-HOLDER FOR KEYS

Key carrying mechanisms of various designs are acknowledged; and particularly U.S. Pat. No. 3,682,216.

The object of this invention is to provide a new and improved mechanism for locating and holding keys inside a purse wall, or other wall, and particularly for a flexible purse wall, by the use of a flexible magnetic tape, fortified with a self-adhesive backing, for quick and easy application to a purse wall constructed of a product such as plastic, leather, fabric or other material. This magnetic tape Locator-Holder is placed near a purse opening providing maximum convenience to the user in depositing keys for holding within the purse; for holding them securely in place; and primarily for providing quick and easy removal of the keys when they again are needed for use.

The keys are attached, by means of a chain or other mechanism, to a fob constructed of selected flat steel which attracts mechanically to magnetic tape.

Magnetic tape is scientifically tested and produced to carry a specified weighted load when the tape and a mated load are suspended perpendicularly in a mating position, inside a purse (or other wall). Optimum load-carrying strength will depend on the surface area, depth, and shape of the tape; size, shape and composition of selected steel in relation to the tape; and relationship of both said tape and said steel to the weighted load to be suspended, all of which is readily determined experimentally.

This magnetic tape may be further fitted with hook-type supports, or other similarly designed supports (at the bottom edge of the magnetic tape), to prevent possible dragging or pulling, by objects within the purse, against the keys and the steel (carrying the keys) mated to the magnetic tape.

Figure 1:
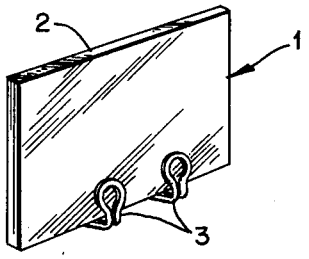

DESCRIPTION OF DRAWINGS INCLUDES:

FIG. 1: Magnetic tape (1) gently slanted outward on three sides (2) to meld with the fabrication of purse; together with metal hooks (3) (or other device) fused into tape or cemented thereto.

Figure 2:
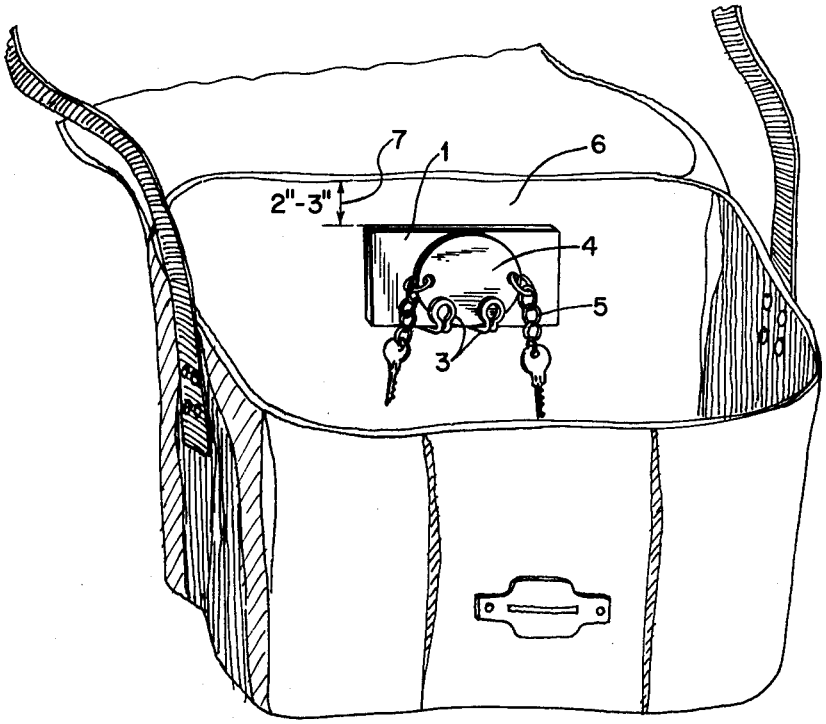

FIG. 2: Steel fob (4) (in selected shape, size, composition and design) with chain (5) (or other key carrying device), mated magnetically to flexible magnetic tape (1); and adhered (with self adhesive) to inside wall of purse (6) at a selected convenient location near a purse opening (7).

What is claimed is:

1. A locator-holder for keys in a purse consisting of a flexible magnetic, self-adhesive tape secured to a purse wall at a point near the purse opening, and adapted to mate magnetically with a steel piece carrying the keys, wherein the magnetic tape is fitted with support means located near the bottom edge of the tape to prevent possible pulling by objects within the purse.

* * * * *